United States Patent [19]

Sallinen

[11] Patent Number: 4,547,000

[45] Date of Patent: Oct. 15, 1985

[54] SOFT-COVER BOOK BLOCK AND METHOD FOR THE MANUFACTURE OF SAME

[76] Inventor: Pentti Sallinen, Kurjentie 7 A, 06100 Porvoo 10, Finland

[21] Appl. No.: 456,014

[22] PCT Filed: Apr. 29, 1982

[86] PCT No.: PCT/FI82/00014

§ 371 Date: Dec. 22, 1982

§ 102(e) Date: Dec. 22, 1982

[87] PCT Pub. No.: WO82/03824

PCT Pub. Date: Nov. 11, 1982

[30] Foreign Application Priority Data

May 5, 1981 [FI] Finland ..... 811377

[51] Int. Cl.[4] ..... B42D 1/00; B42D 3/00; B42C 11/00

[52] U.S. Cl. ..... 281/23; 281/35; 281/36; 412/4; 412/5

[58] Field of Search ..... 281/29, 35, 36, 23; 412/4, 5, 21

[56] References Cited

U.S. PATENT DOCUMENTS 951,436 3/1910 Duryea ..... 281/23

998,283 7/1911 Duryea et al. ..... 281/23

3,437,506 4/1969 Falberg ..... 281/21 R

FOREIGN PATENT DOCUMENTS 0791516 of 1979 Finland .

0490869 2/1954 Italy ..... 281/29

*Primary Examiner*—Paul A. Bell

*Assistant Examiner*—Taylor J. Ross

*Attorney, Agent, or Firm*—Burns, Doane, Swecker & Mathis

[57] ABSTRACT

A soft-cover book block, which comprises a book block (1) consisting of leaves joined together at their spine edges, a soft cover (2) fastened to the book block, as well as a member for fastening the soft cover to the book block so that the spine part (5) of the cover (2) is apart from the spine (4) of the book block (1), is manufactured so that a resiliently compressible sleeve (3), which is non-penetrable by glue, functions as the fastening member, and whose circuit is at least twice the width of the spine (4) of the book block (1) and whose length is preferably equal to the height of the spine of the book block, is fastened at one side onto the spine part (5) of the cover (2) and thereinafter at the opposite side onto the spine (4) of the book block (1).

9 Claims, 2 Drawing Figures

SOFT-COVER BOOK BLOCK AND METHOD FOR THE MANUFACTURE OF SAME

Figure 1:
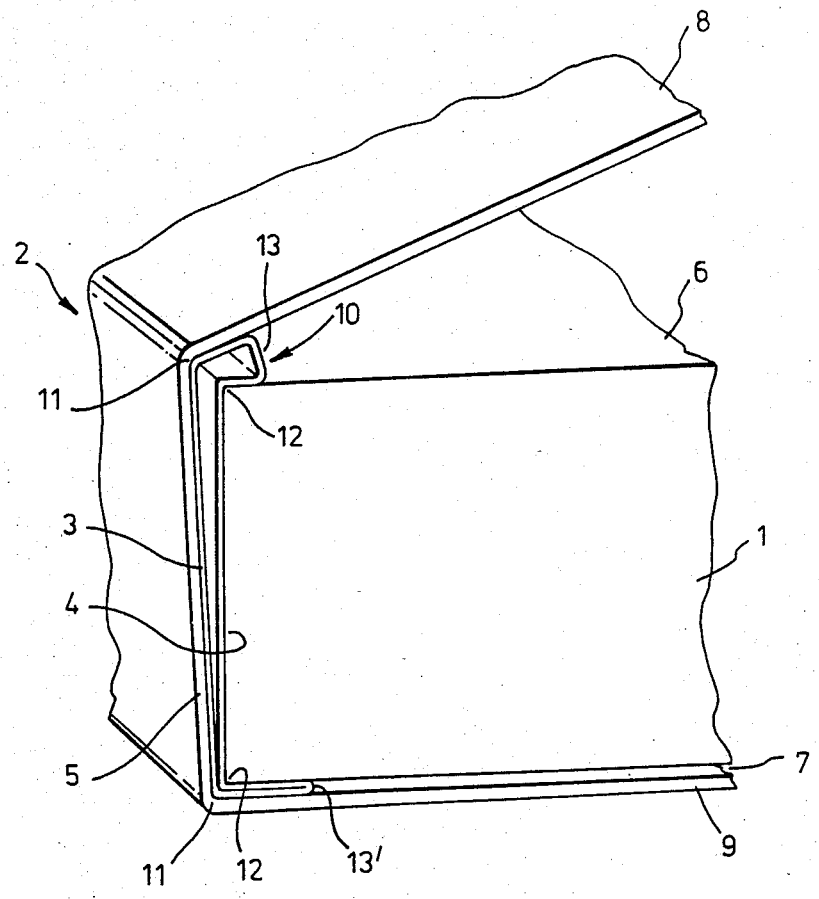

The present invention is concerned with a soft-cover book block and in particular with such a soft-cover book block as comprises a book block consisting of sheets, leaves, etc. joined together at their back edges, a soft cover fastened to the book block, as well as a member for fastening the soft cover to the book block so that the spine part of the cover is apart from the back part of the book block. In the present connection, the spine part is understood as meaning, in addition to the spine proper of the cover, also an area that extends partly beyond the folding lines of the spine towards the opening side of the book.

In the prior-art soft-cover book blocks, the book block is usually glued onto the spine of the soft cover over its entire length and width, and in some cases the cover is additionally glued over a certain distance from the back edge of the book block onto the first and last leaf of the book block so as to obtain a stronger fastening between the cover and the book block. The spine of a book made in this way is rather rigid, whereby the book opens itself poorly and is difficult to read. This is why the spine of the book is readily broken, and especially the first and last leaves of the book block tend to be detached when attempts are made to turn the leaves of the book more open by force.

From the Finnish Patent Application No. 791,516, a soft-cover paperback book is known in which a support layer is fastened to the back of the book block and the soft cover is fastened to the book block only at its front and back cover along fastening strips running at the back edges of the first and last leaf of the book block, so that the spine portion of the cover between the fastening strips is loose from the back of the book block. In this prior-art solution, the spine of the soft cover is not fastened to the back of the book block, whereby the spine is not fastened to the leaves of the book block. Instead, in order to join the book block together, a thin, flexible, strong support layer is used, such as a crepe strip, which is fastened to the back of the book block and which does not subtantially prevent opening of the leaves of the book. In this way, a more readily openable soft-cover paperback book has been provided.

As compared with the first-mentioned solution, this second solution, however, involves the drawback that a separate support layer is required to join the book block together, in addition to which the soft cover is fastened to the book block only along narrow fastening strips placed at its front and back cover.

Under these circumstances, the objective of the present invention is to provide a soft-cover book block wherein the soft cover is, by means of a separate fastening member, fastened to the book block so that the spine portion of the cover is apart from the back portion of the block, so that no excessive strains are directed at the book block and especially not at its first and last leaves, but wherein the fastening is, nevertheless, performed substantially over the entire face of the spine portion of the soft cover and the back of the book block so as to achieve a fastening that is of maximum strength but, yet, flexible, between the soft cover and the book block. Thus, by means of the present invention, the advantages present in the two prior-art solutions mentioned above have been obtained without their drawbacks.

It is a further objective of the present invention to provide a method for the manufacture of a soft-cover book block by glueing the soft cover onto the book block by the intermediate of a separate fastening member non-penetrable by glue, so that the spine portion of the cover is apart from the back portion of the book block.

In a preferred embodiment of the invention, the circumference of the elastically flexible sleeve, non-penetrable by glue, functioning as the fastening member, is preferably somewhat larger than twice the width of the back of the book block, so that the sleeve extends a certain distance between the first leaf of the book block and the front cover and between the last leaf of the book block and the back cover. Moreover, the use of such a sleeve is rather independent from the thickness of the book block, whereby similar sleeves can be used for soft-cover book blocks of different thicknesses.

Except over the entire width of the spine portion of the cover and of the back portion of the book block, the sleeve may also be fastened only over the width of the spine of the cover and the width of the back of the book block. When a wider sleeve is used, it is, however, advantageous not to apply glue to the end portions of the sleeve between the front cover and the first leaf and between the back cover and the last leaf, in order that a resilient fold should be formed between the front cover and the first leaf and between the back cover and the last leaf. In this way the sleeve functioning as the support member can be fastened more efficiently to the first and last page of the book block without, however, any high strains being directed at these pages on opening of the cover, because the flexible fold between the cover and the first or last page efficiently attenuates strains directed at the first and last page.

A soft-cover book block in accordance with the invention is manufactured advantageously so that the flexible sleeve non-penetrable by glue, functioning as the fastening member, is first hot-glued onto the spine portion of the cover, and thereupon the book block is glued by its back portion onto the sleeve fastened to the cover. The book block may be glued onto the sleeve, e.g., by means of hot-setting adhesive or by cold-glueing. By means of the fastening mode in accordance with the invention, a very large glueing area is achieved, i.e. a strong construction, which is, however, elastic, which means that the first and last pages of the book do not tend to be detached when the book is handled, and the book opens itself readily, because the cover is not directly fixed to the book block.

Figure 2:
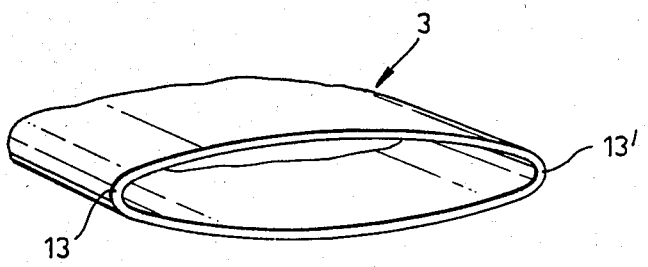

The invention will be described below in more detail with reference to the attached drawing, wherein FIG. 1 is a partial perspective view of a popular embodiment of the invention, and FIG. 2 is a partial perspective view of an elastically flexible sleeve used in the embodiment shown in FIG. 1.

In FIG. 1, the book block is denoted with reference numeral 1, and its first page with reference numeral 6, and its last page with reference numeral 7. The spine of the book block 1 is denoted with reference numeral 4 and its back edges with reference numeral 12.

The soft cover is generally denoted with reference numeral 2, and its front cover with reference numeral 8 and its back cover with reference numeral 9. The spine portion of the soft cover 2 is denoted with reference numeral 5, and the spine edges with reference numeral 11.

As is seen from FIG. 1, the book block 1 and the soft cover 2 are fixed to each other by their back and spine portions 4 and 5, respectively, by means of the elastically flexible sleeve 3 non-penetrable by glue, functioning as the fastening member. This sleeve 3 is shown in more detail in FIG. 2.

As is seen from FIG. 1, the circumference of the sleeve 3 is so large that it extends somewhat beyond the back edges 12 of the book block 1 and beyond the spine edges 11 of the cover 2 and is glued, besides over the entire width of the back 4 of the book block 1 and of the spine portion 5 of the soft cover 2, also a certain distance onto the first leaf 6 and the last leaf 7 of the book block as well as, correspondingly, onto the front cover 8 and the back cover 9 of the soft cover 2. The sleeve 3 has, however, not been glued onto the cover 2 and onto the book block 1 over its entire circuit, i.e. from the fold 13 between the front cover 8 and the first leaf 6 to the fold 13' between the last leaf 7 and the back cover 9, but the application of glue has been ended slightly before the folds 13 and 13'. Thereby the portion of the sleeve 3 that passes beyond the back edge 12 of the book block 1 and beyond the spine edge 11 of the cover forms a resilient fastening 10, which attenuates the strains directed at the first 6 and last 7 leaf of the book block 1 when the front cover 8 and the back cover 9 are being turned, and, nevertheless, the book block 1 and the cover 2 are glued, besides over their entire back and spine portions 4 and 5, also somewhat beyond their back and spine edges 12 and 11 so as to achieve a fastening of maximum strength between the book block 1 and the cover 2, without, however, resulting in a rigidly openable and therefore readily breaking construction.

The manufacture of the soft-cover book block shown in FIG. 1 takes place so that first, glue is applied as hot onto the spine portion 5 of the soft cover so that the application of glue extends somewhat beyond the spine edges 11 of the spine portion 5. The width of the glue is, however, somewhat narrower than the width of the sleeve shown in FIG. 2 when the sleeve is fully compressed, i.e. somewhat narrower than the distance between the folds 13 and 13'. Hereupon glue is applied either as hot or as cold over the entire width of the book block 1 and slightly beyond its back edges 12. The width of the glueing is, however, preferably slightly narrower than the width of the compressed sleeve shown in FIG. 2, i.e. than the distance between the folds 13 and 13' of the said sleeve. Finally, the sleeve 3 fixed by glueing onto the cover 2 is fastened by glueing onto the book block 1.

The sleeve 3 is made of paper or some elastically flexible material such as plastic or crepe non-penetrable by glue. Besides by means of glue-binding, the book block may also be prepared by thread-stitching.

It is evident that, in addition to this, a separate support crepe may be fastened onto the back of the book block in a way in itself known, whereby the book block is fastened to the sleeve by means of this supporting crepe. Likewise, it is evident, even though not particularly advantageous, that the circumference of the sleeve, especially when a supporting crepe is used, is at the maximum twice the thickness of the back of the book block. It is equally evident that the sleeve may be fastened first to the book block and the cover be fastened only thereinafter onto the sleeve fixed to the book block.

Finally, it should still be stated that, instead of one sleeve, it is of course possible to use two or more sleeves placed side by side and/or one after the other, the said sleeves being either in contact with each other or at a distance from each other.

What is claimed is:

1. A soft-cover book comprising a book block comprising a plurality of leaves joined together and forming a back having a width and back edges, a soft cover comprising front and back cover pieces connected by a spine, and a fastening member interposed between the spine of said soft cover and the back of said book block so that the spine of said soft cover is apart from the back of said book block, wherein said fastening member comprises at least one collapsed tubular sleeve, whose circumference is collapsed across said width, said collapsed tubular sleeve being at one side, fastened to the back of said book block and, at the opposite side, to the spine of said soft cover, wherein said circumference of the sleeve is larger than twice said width, so that the sleeve extends beyond said back edges a distance between the first of said leaves and the front cover piece and a distance between the last of said leaves and the back cover piece.

2. A soft cover book as claimed in claim 1, wherein the sleeve is fastened also to said front cover piece and said first leaf along less than all said distance beyond said back edge and also to said back cover piece and said last leaf along less than all said distance beyond said back edge to provide flexible fastening between the front cover piece and said first leaf and between the back cover piece and said last leaf.

3. A method of manufacturing a soft-cover book, comprising the steps of:

forming a book block having first and last leaves and a back with a width and back edges;

forming a soft cover having front and back cover pieces and a spine connecting said piece along spine edges;

forming a collapsible tubular fastening sleeve;

fastening said fastening sleeve to the spine of said soft cover;

fastening said book block at its back to said fastening sleeve in a manner compressing said fastening sleeve between said soft cover and said book block;

wherein said fastening sleeve is constructed from material non-penetrable by glue and said fastening steps are accomplished with glue; and wherein the sleeve has a circumference larger than twice the width of the back of said book block and the glueing of the sleeve onto the soft cover is extended a certain distance beyond the spine edges of the soft cover onto the front and back cover pieces.

4. A method as claimed in claim 3, wherein the glueing of the book block onto the sleeve is extended a certain distance beyond the back edges of the book block onto the first and last leaf.

5. A method as claimed in claim 4, wherein during the glueing steps narrow glue-free strips are allowed to remain on the portions of the sleeve positioned between the front cover and the first leaf and between the back cover and the last leaf.

6. A method as claimed in claim 3, wherein during the glueing steps narrow glue-free strips are allowed to remain on the portions of the sleeve positioned between the front cover and the first leaf and between the back cover and the last leaf.

7. A method of manufacturing a soft-cover book, comprising the steps of:

forming a book block having first and last leaves and a back with a width and back edges;

forming a soft cover having front and back cover pieces and a spine connecting said pieces along spine edges;

forming a collapsible tubular fastening sleeve;

fastening said fastening sleeve to the spine of said soft cover;

fastening said book block at its back to said fastening sleeve in a manner compressing said fastening sleeve between said soft cover and said book block;

wherein said fastening sleeve is constructed from material non-penetrable by glue and said fastening steps are accomplished with glue; and wherein during the glueing steps, narrow glue-free strips are allowed to remain on portions of the sleeve positioned between the front cover and the first leaf and between the back over and the last leaf.

8. A method of manufacturing a soft-cover book comprising the steps of:

forming a book block having first and last leaves and a back with a width and back edges;

forming a soft cover having front and back cover pieces and a spine connecting said pieces along spine edges;

forming a collapsible tubular fastening sleeve;

fastening said fastening sleeve to the spine of said soft cover;

fastening said book block at its back to said fastening sleeve in a manner compressing said fastening sleeve between said soft cover and said book block;

wherein said fastening sleeve is constructed from material non-penetrable by glue and said fastening steps are accomplished with glue; and wherein the sleeve has a circumference larger than twice the width of the back of said book block and the glueing of the book block onto the sleeve is extended a certain distance beyond the back edges of the book block onto the first and last leaf.

9. A method as claimed in claim 8, wherein during the glueing steps narrow glue-free strips are allowed to remain on the portions of the sleeve positioned between the front cover and the first leaf and between the back cover and the last leaf.

* * * * *